US007001239B2

(12) United States Patent
Russell

(10) Patent No.: US 7,001,239 B2
(45) Date of Patent: Feb. 21, 2006

(54) CLEAVAGE ANTI-WRINKLE DEVICE

(76) Inventor: Midge Russell, P.O. Box 503, North Beach, MD (US) 20714

( * ) Notice: Subject to any disclaimer, the term of this patent is extended or adjusted under 35 U.S.C. 154(b) by 158 days.

(21) Appl. No.: 10/641,096

(22) Filed: Aug. 15, 2003

(65) Prior Publication Data

US 2005/0037688 A1 Feb. 17, 2005

(51) Int. Cl.
*A41C 3/00* (2006.01)

(52) U.S. Cl. ..... 450/5 T; 450/54; 450/39; 2/267

(58) Field of Classification Search ..... 450/54–57, 450/39, 31, 32, 89; 2/92, 467, 267, 268, 2/113–115, 69, 1, 73, 78.1–78.4, 463; 602/60, 602/61; 128/845, 846, 848, 873–876, 889–891; 623/7, 8

See application file for complete search history.

(56) References Cited

U.S. PATENT DOCUMENTS 4,854,915 A * 8/1989 Luedy ..... 450/31
5,054,143 A 10/1991 Javaher
5,083,555 A 1/1992 Lewis
5,158,541 A * 10/1992 McCurley ..... 602/79
5,439,409 A * 8/1995 McCracken et al. ..... 450/31
5,806,103 A * 9/1998 McCracken et al. ..... 2/455
5,807,160 A * 9/1998 Wehmeyer ..... 450/57
D404,237 S 1/1999 Boyd
D410,810 S 6/1999 Lozier
D412,082 S 7/1999 Goodrich
6,095,894 A * 8/2000 Stevens ..... 450/57
6,102,772 A * 8/2000 Fernandez ..... 450/1
D448,961 S 10/2001 Sclichter
6,769,955 B1 * 8/2004 Fisher ..... 450/54

FOREIGN PATENT DOCUMENTS

JP 9149846 6/1997

* cited by examiner

*Primary Examiner*—Gloria M. Hale
(74) *Attorney, Agent, or Firm*—Richard C. Litman

(57) ABSTRACT

An anti-wrinkle device is a light-weight, rigid, hollow member ergonomically contoured to fit comfortably in the area between the breasts of a human female. The hollow member is designed to prevent wrinkles from occurring in the cleavage area when women are lying on their shoulders and/or sides while sleeping. The member is covered with a soft, removable washable fabric. A sleeveless top can be worn to hold the member in place.

9 Claims, 5 Drawing Sheets

CLEAVAGE ANTI-WRINKLE DEVICE

BACKGROUND OF THE INVENTION

1. Field of the Invention

The present invention generally relates to women's sleep accessories. More specifically the present invention is drawn to a device for preventing wrinkles that might develop in the cleavage area of a women's breast.

2. Description of the Related Art

Modern fashion often dictates that a woman's wardrobe includes dresses, blouses and sportswear with low-cut necklines. Unfortunately, the soft skin in the cleavage area of the breast wrinkles very easily and such wrinkles detract from the aesthetics of wearing the fashionable low-cut garments.

There are many reasons why the unattractive wrinkles may form; age, over exposure to sunlight, loss of weight, etc. One of the main causes, however, occurs when women (especially women with larger breasts) sleep on their sides and the forces of gravity tend to pull the breast disposed in the upper position downward toward the lower positioned breast. This situation stretches the soft skin in the cleavage area and causes such skin to become wrinkled. A device or apparatus that would prevent the above occurrence and still allow a user to maintain an acceptable comfort level would surely be a welcome addition to the art.

The related art is rife with devices for preventing wrinkles in the human skin. For example U.S. Pat. No. Des. 404,237 (Boyd), U.S. Pat. No. Des. 410,810 (Lozier), U.S. Pat. No. 5,054,143 (Javaher) and Japanese Patent JP9149846 (Yoshifumi) show pillows adapted and designed to prevent wrinkles from forming in the face of a sleeping person. The pillows would not be effective for use in the breast area.

U.S. Pat. No. Des. 412,082 (Goodrich) and U.S. Pat. No. D448,961 S (Sclichter) disclose pillows for supporting breasts during sleep. There is no disclosure that the pillows can prevent wrinkles.

The most pertinent related art appears to be disclosed in U.S. Pat. No. 5,083,555 (Lewis) and U.S. Pat. No. 5,807,160 (Wehmeyer) which show apparatus employed to separate the breast while the user is sleeping. The instant apparatus lacks the rigidity and configuration to be totally effective. The devices also employ relatively uncomfortable covering and securing means.

None of the above inventions and patents, taken either singly or in combination, is seen to disclose an anti-wrinkle device for preventing wrinkles in the cleavage area of a human female as will subsequently be described and claimed in the instant invention.

SUMMARY OF THE INVENTION

The anti-wrinkle device of the instant invention is a light-weight, rigid, hollow member ergonomically contoured to fit comfortably in the cleavage area between the breasts of a human female. The hollow member is designed to prevent wrinkles from occurring in the cleavage area when women are lying on their sides while sleeping. The member is covered with a soft, removable washable fabric. A sleeveless top is worn to hold the member in place.

Accordingly, it is a principal object of the invention to provide a device for preventing and reducing the occurrence of wrinkles in the cleavage area of a human female.

It is another object of the invention to provide a device for preventing and reducing the occurrence of wrinkles in the cleavage area of a human female, which device is rigid so as to be effective in accomplishing its task.

It is a further object of the invention to provide a device for preventing and reducing the occurrence of wrinkles in the cleavage area of a human female, which device is ergonomically contoured for comfortable wear.

Still another object of the invention is to provide a device for preventing and reducing the occurrence of wrinkles in the cleavage area of a human female, which device is easy to use.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
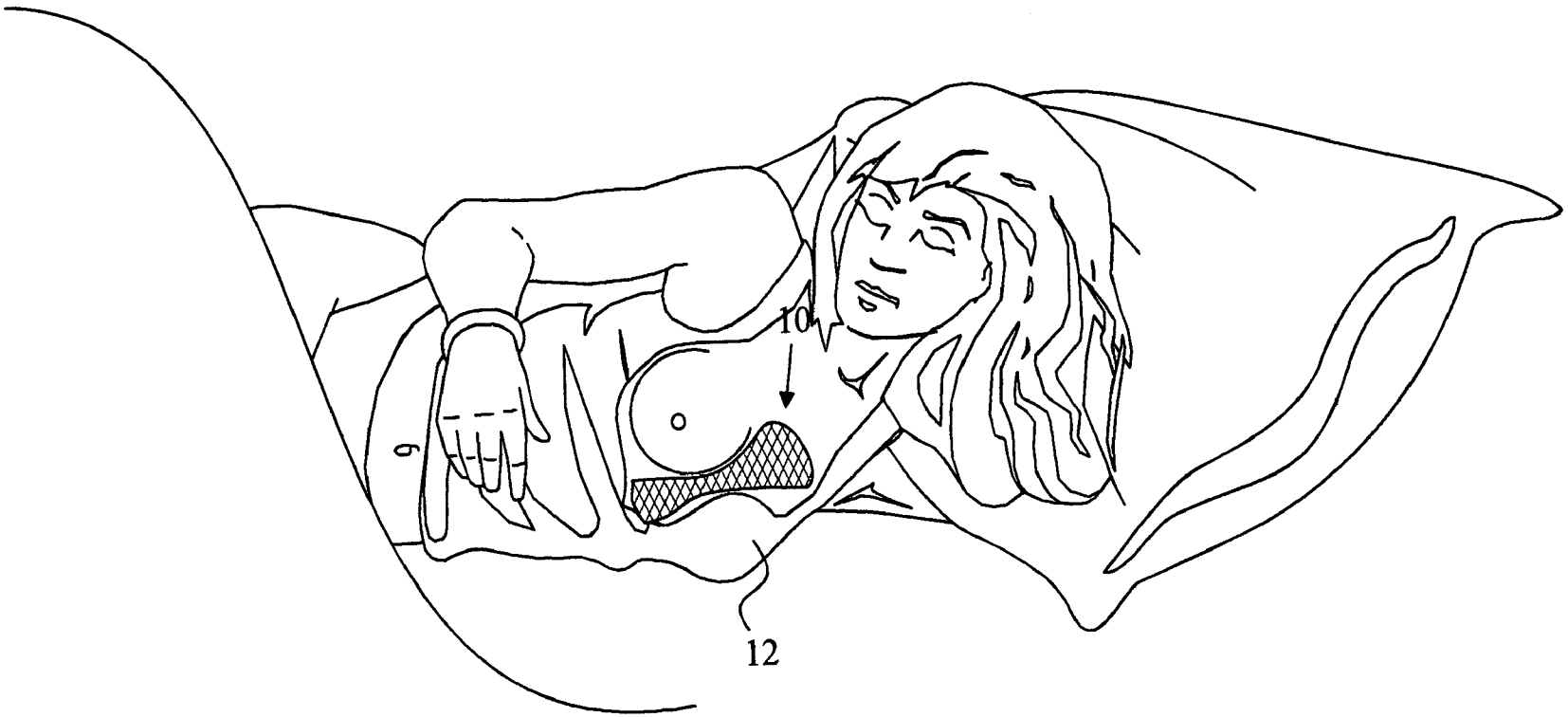
FIG. 1 is an environmental, perspective view of an anti-wrinkle device according to the present invention.
Figure 2:
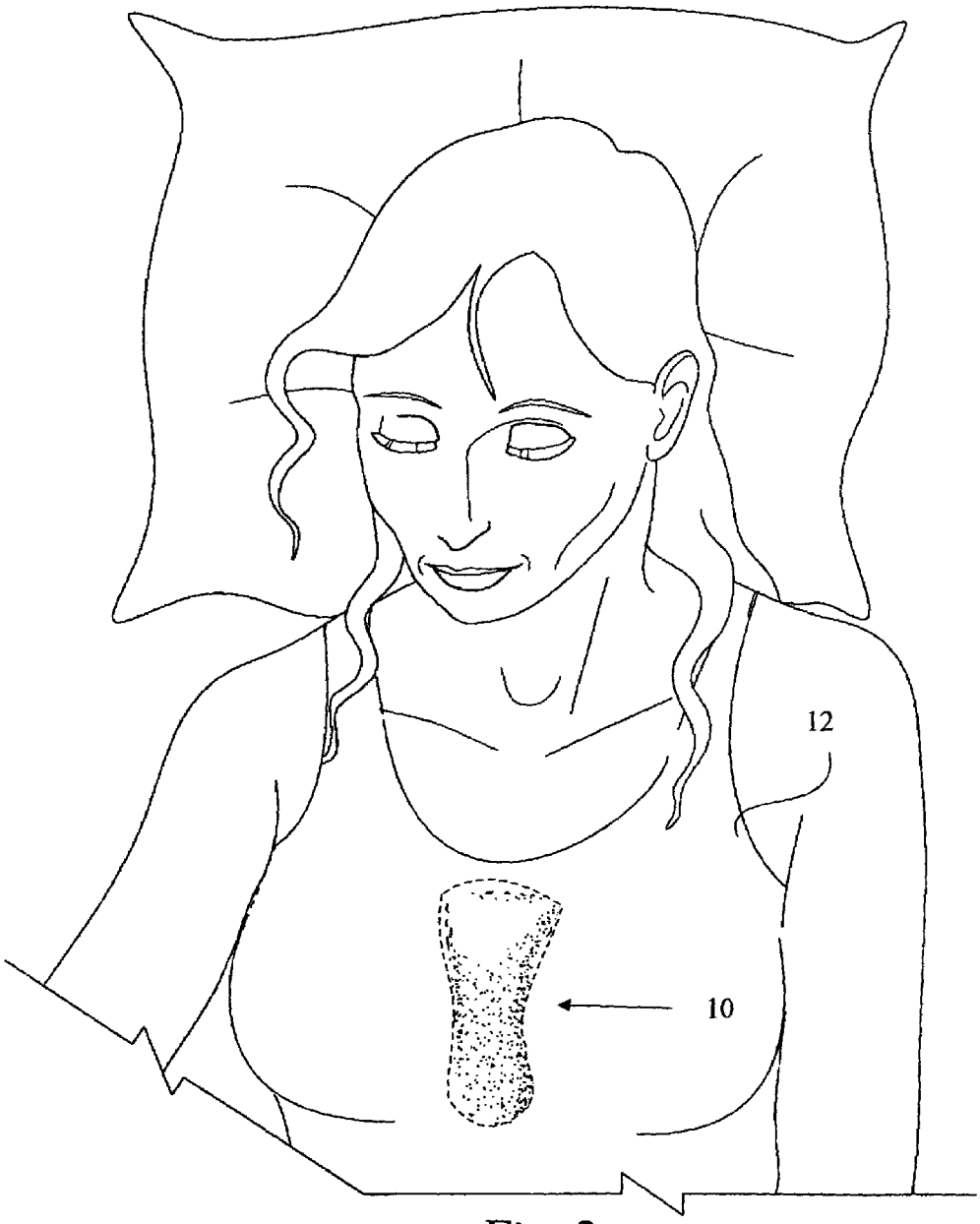
FIG. 2 is an environmental, partial top view of an anti-wrinkle device according to the present invention.

Attention is first directed to FIGS. 1 and 2 wherein the ant-wrinkle device of the instant invention is generally indicated at 10. In use, anti-wrinkle device 10 is disposed in the cleavage area between the breasts of a user. Note that the larger end of the device is positioned adjacent the top of the cleavage area. A sleeveless shirt 12, preferably made of a stretchable material, is worn to comfortably secure the device in the cleavage area. The shirt will have a neckline that terminates just above the cleavage. Anti-wrinkle device 10 functions to keep the breasts separated and to prevent the gravity induced sagging that causes wrinkles to appear in the cleavage area.

Figure 3:
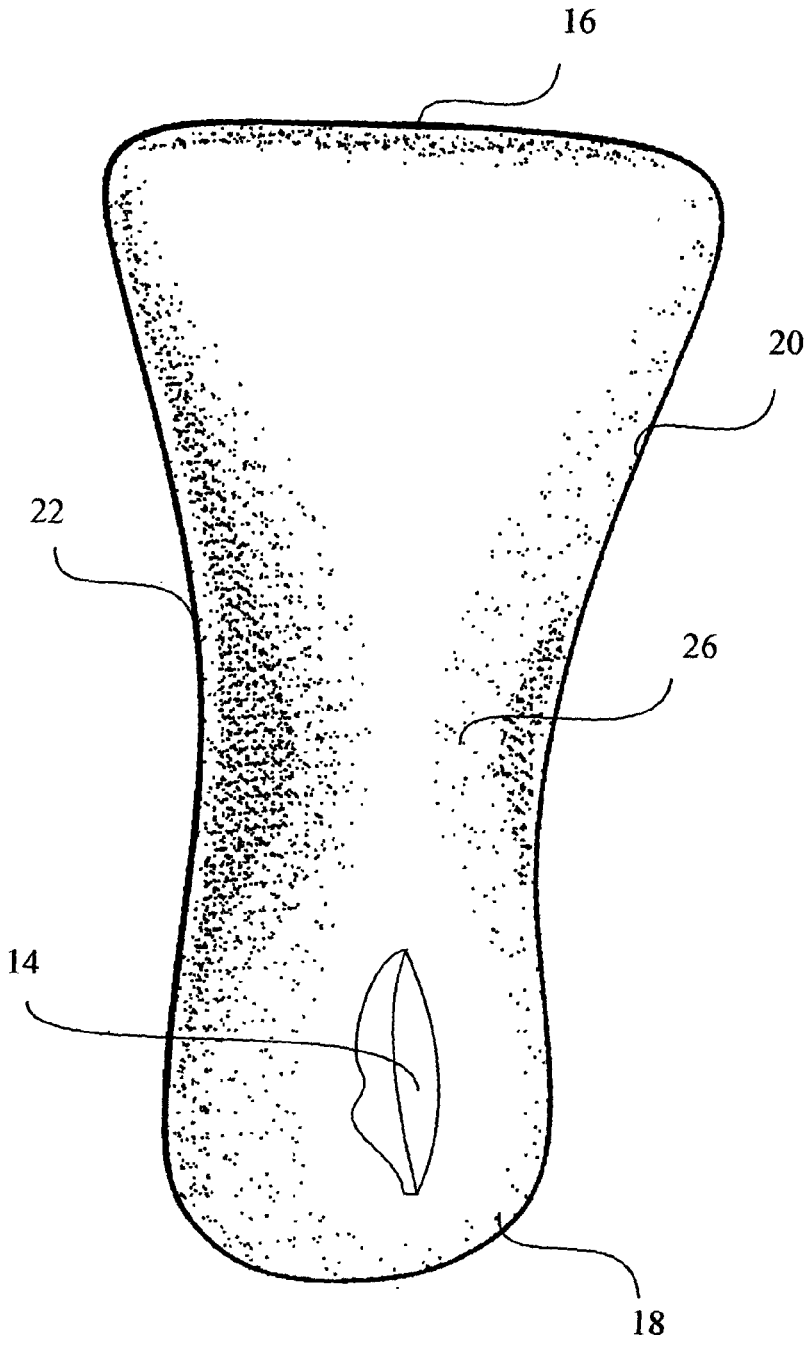
FIG. 3 is a front view of an anti-wrinkle device according to the present invention.
Figure 4:
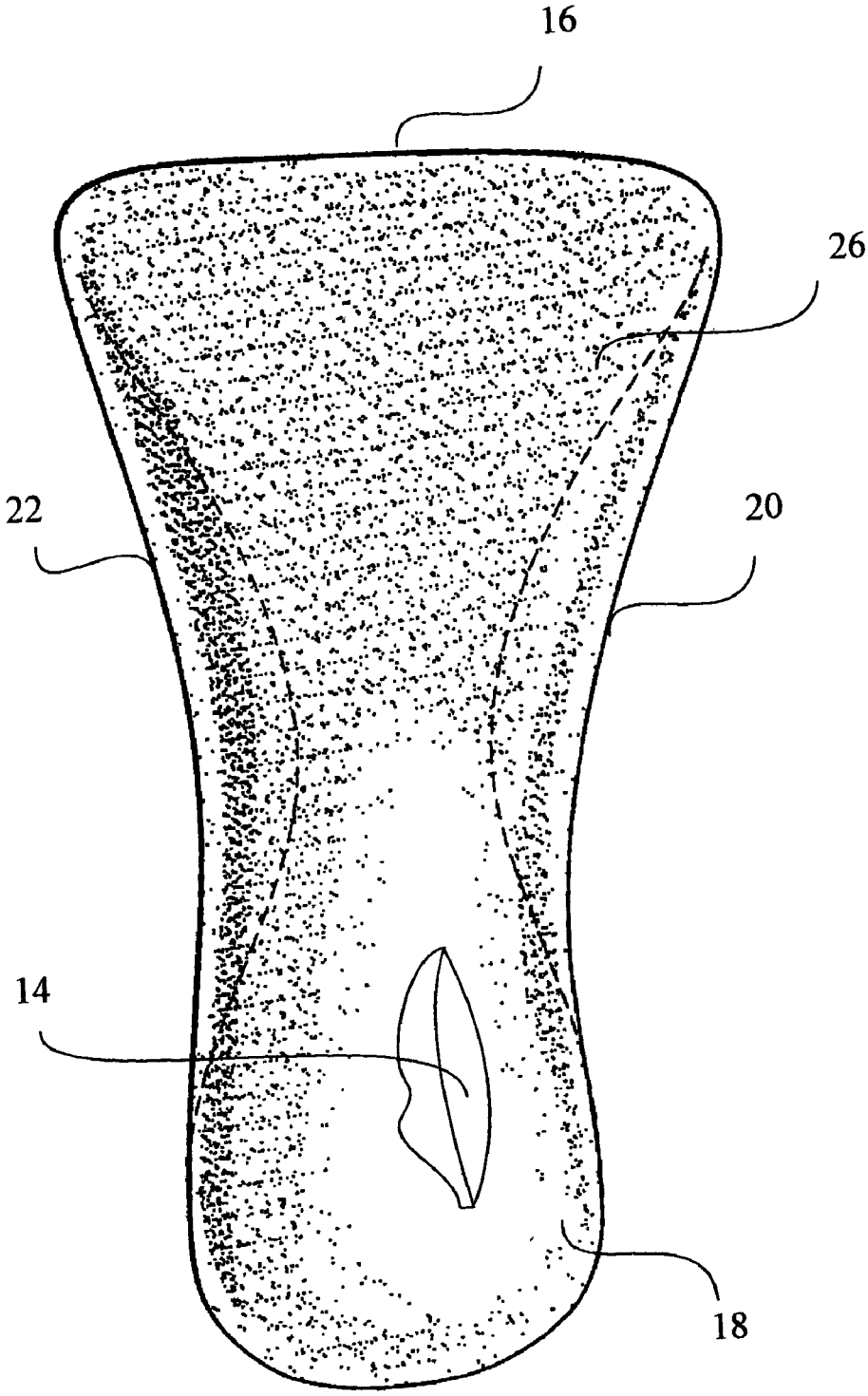
FIG. 4 is a rear view of an anti-wrinkle device according to the present invention.
Figure 5:
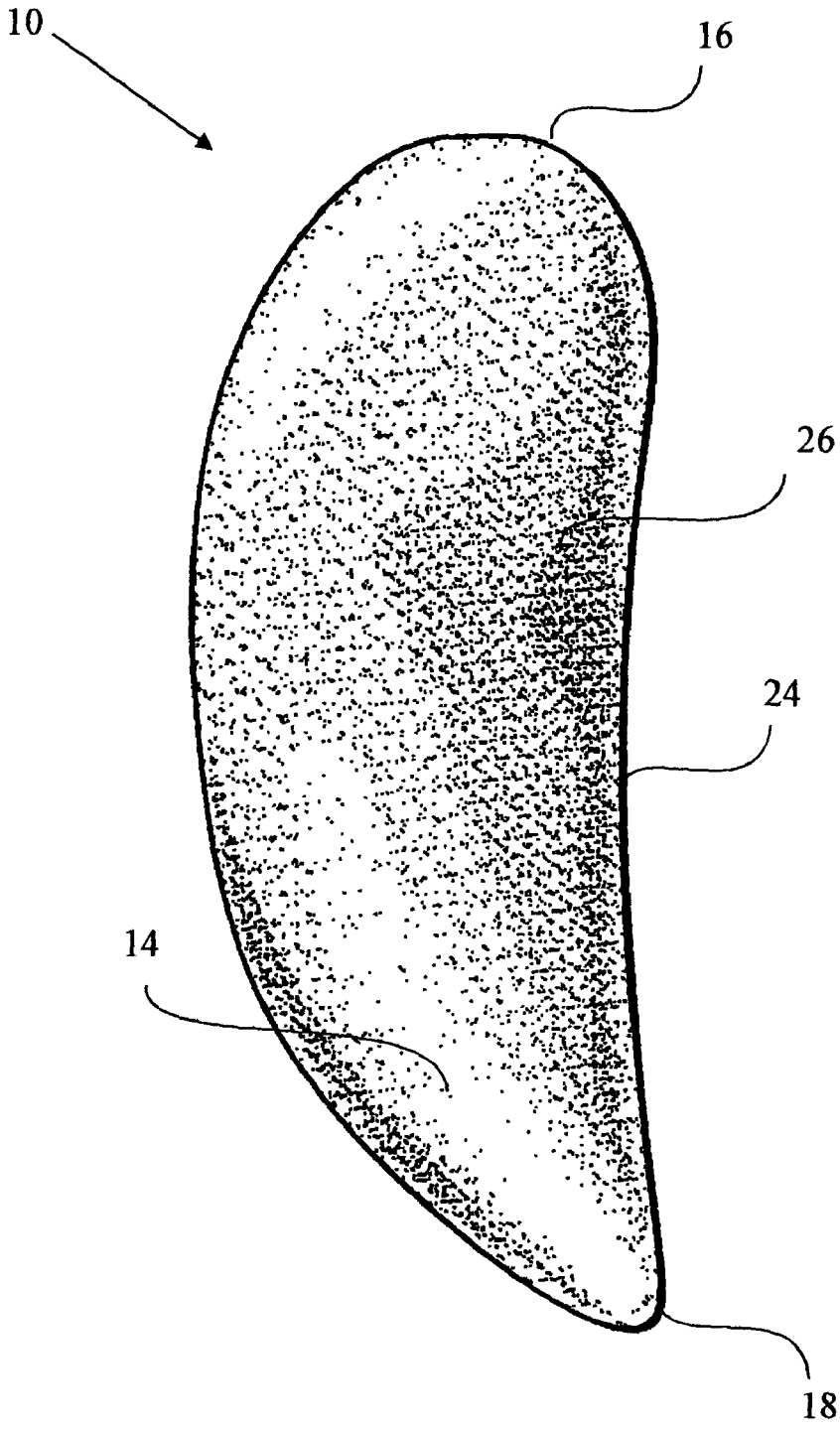
FIG. 5 is a side view of an anti wrinkle device according to the present invention.

As best seen in FIGS. 3–5, anti-wrinkle device 10 comprises a body member 14 fabricated from a rigid plastic material. It has been determined that a rigid material is more effective in preventing wrinkles than the flexible and semi-rigid materials employed in the related art. Body member 14 is of a one-piece construction with a continuous outer surface and is hollow to reduce its weight. Body member 14 is ergonomically designed for comfort. The proximate end 16 and distal end 18 are rounded. Proximate end 16 has a larger diameter than does distal end 18. The side areas 20 and 22 are concave. The rear 24 of the member has an arcuate configuration so as to conform to the natural contour of the human female torso. Member 14 will be encased in a soft, washable, moisture-absorbing cover 26. Cover 26 is easily removable and is preferably made of terrycloth or the like. As contemplated the anti-wrinkle device will be made in various standard sizes to accommodate different breast sizes.

It is to be understood that the present invention is not limited to the embodiment described above, but encompasses any and all embodiments within the scope of the following claims.

I claim:

1. A device for preventing wrinkles in the area of the breasts of a human female comprising:

a contoured one-piece member constructed of a rigid material, said member having a continuous outer surface encapsulating a hollow interior, a rounded proximate end, a rounded distal end, a first concave side and a second concave side, said first concave side and said second concave side extending from said rounded proximate end to said rounded distal end;

said rounded proximate end having a larger diameter than said rounded distal end; and a soft, moisture absorbing fabric tightly covering said continuous outer surface of said member.

2. A device for preventing wrinkles in the area of the breasts of a human female as recited in claim 1, wherein said rigid material is a plastic material.

3. A device for preventing wrinkles in the area of the breasts of a human female as recited in claim 1, wherein said rigid member has a rear surface and wherein said rear surface has an arcuate configuration.

4. A device for preventing wrinkles in the area of the breasts of a human female as recited in claim 1, wherein said soft, moisture absorbing fabric is terrycloth.

5. A device for preventing wrinkles in the area of the breasts of a human female as recited in claim 1, wherein said soft, moisture absorbing fabric is easily removable.

6. A device for preventing wrinkles in the cleavage area of the breasts of a human female comprising:

a contoured one-piece member constructed of a rigid material, said member having a continuous outer surface encapsulating a hollow interior, a rounded proximate end, a rounded distal end, a first concave side a second concave side and an arcuate rear surface said first concave side, said second concave side and said arcuate rear surface extending from said rounded proximate end to said rounded distal end;

said rounded proximate end having a larger diameter than said rounded distal end;

a soft, moisture absorbing fabric tightly covering said continuous outer surface of said member and easily removable therefrom; and a sleeveless shirt for securing said device to the cleavage area.

7. A device for preventing wrinkles in the cleavage area of the breasts of a human female as recited in claim 6, wherein said soft, moisture absorbing fabric is terrycloth.

8. A device for preventing wrinkles in the cleavage area of the breasts of a human female as recited in claim 7, wherein said rigid material is plastic.

9. A device for preventing wrinkles in the cleavage area of the breasts of a human female as recited in claim 8 wherein said sleeveless shirt is made from stretchable material.

* * * * *